US006298798B1

(12) United States Patent
Nomura et al.

(10) Patent No.: US 6,298,798 B1
(45) Date of Patent: Oct. 9, 2001

(54) BUTTONHOLE FORMING APPARATUS FOR SEWING MACHINE

(75) Inventors: Etsuzo Nomura, Kasugai; Akihiro Funahashi, Handa; Takashi Kondo, Oobu; Jun Gamano, Okazaki; Itaru Shibata, Nagoya, all of (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/526,444

(22) Filed: Mar. 16, 2000

(30) Foreign Application Priority Data

Mar. 16, 1999 (JP) ..... 11-070446

(51) Int. Cl.[7] ..... D05B 37/02
(52) U.S. Cl. ..... 112/68
(58) Field of Search ..... 112/65, 66, 68

(56) References Cited

U.S. PATENT DOCUMENTS 3,565,732 * 2/1971 Colianni ..... 112/68 X
5,085,158 * 2/1992 Goldbeck et al. ..... 112/68 X
5,974,990 * 11/1999 Goldbeck et al. ..... 112/68
6,142,087 * 11/2000 Pofalla et al. ..... 112/68

* cited by examiner

*Primary Examiner*—Ismael Izaguirre
(74) *Attorney, Agent, or Firm*—Oliff & Berridge, PLC

(57) ABSTRACT

A buttonhole forming apparatus includes a cutter, a cutter driving mechanism, and a needle plate. The needle plate has a needle plate base to hold a work cloth thereon and a pair of cutter guides in a recess to guide an edge of the cutter therein. The cutter guides are made of hard material on the inside and rubber on the outside. The hard material can be moved outward by the resilience of the rubber. The width of the cutter hole defined between the cutter guides is set as small as possible so that the cutter does not force the work cloth into the cutter hole when it is lowered where it remains clogged. When the cutter is gradually lowered, the edge of the cutter or a part of the work cloth to be cut makes contact with the tapered portions of the cutter guides, and the rubber is deformed to move the cutter guides outward. Thus, the cutting into the work cloth can be done as the width of the cutter is gradually enlarged, resulting in the formation of appropriate buttonholes without any interruption because the work cloth becomes clogged in the cutter hole.

21 Claims, 13 Drawing Sheets

BUTTONHOLE FORMING APPARATUS FOR SEWING MACHINE

BACKGROUND OF THE INVENTION

1. Field of Invention

The invention relates to a buttonhole forming apparatus that is provided on a buttonhole sewing machine and forms a buttonhole on a work cloth by stitching a buttonhole and cutting a slit.

2. Description of Related Art

A conventional buttonhole sewing machine comprises a sewing device where buttonhole stitches are made on a work cloth, a cutter that makes a cut between buttonhole stitches made by the sewing device, a cutter driving mechanism that drives the cutter to move vertically, and a supporting device that supports the work cloth thereon having a cutter hole where the top of the cutter is inserted. A buttonhole forming apparatus is thought to be included in such a buttonhole sewing machine.

On this kind of buttonhole forming apparatus, a work cloth is held on the top of the supporting device, in which buttonhole stitches are made, the cutter vertically driven by the cutter driving mechanism is inserted through the work cloth into the cutter hole and then pulled out therefrom. Thus, a cut is made between the buttonhole stitches made by the sewing device, and finally a buttonhole is formed.

So far, a cutter driving mechanism has been arranged in most cases that a driving force of the machine motor is mechanically transmitted to the cutter via a link system, and the cutter cuts the work cloth.

However, application of such a mechanical cutter driving mechanism to a machine provides the cutter with the necessary driving force, but the operation of the cutter is slow, therefore the reduction of the cycle time of the machine is longer than desired.

In addition, currently being developed by the assignee of the instant application, is an air cylinder that can be used to drive the cutter driving mechanism. In this case, the operational speed of the cutter is increased, but the cutting performance of the cutting device cannot be fully assured. Moreover, in another ongoing development, the cutter driving mechanism is driven by a solenoid, the operational speed of the cutter would be expected to be faster, but the cutter may not return to its original position, as it may be kept inserted into the work cloth.

For example, as shown in FIG. 11, the needle plate 151 having a cutter hole 167 with the same width as the thickness of the cutter is disposed on the bed of the buttonhole sewing machine as the supporting device. A buttonhole is formed on a work cloth placed on the top 151*a* of the needle plate 151. In this case, the sewing device, such as a needle (not shown), forms buttonhole stitches in ranges indicated by A on both sides, a top of the cutter 13 is inserted into the cutter hole 167 to cut the work cloth, and a buttonhole is defined. However, as is obvious from FIG. 11, the work cloth W may be caught between the cutter hole 167 and the edge of the cutter 13, and the cutter 13 may not be returned to its original position only by the action of an air cylinder or a restoring spring of the solenoid (not shown).

This problem of catching of the work cloth is thought of as the use of an air cylinder or solenoid cannot secure the required cutting performance. Therefore, if the cutter driving mechanism is arranged using the air cylinder or the solenoid, the cycle time can be reduced but buttonholes can not be correctly formed on a thicker material.

SUMMARY OF THE INVENTION

The invention was made in consideration of the above circumstances. It is an object of the invention to provide a buttonhole forming apparatus for a sewing machine that can form buttonholes correctly and smoothly on a thick and heavy cloth and fully realize a cycle time reduction in the buttonhole forming process.

The buttonhole forming apparatus, which has been designed so as to accomplish the object, comprises a cutter that cuts a buttonhole slit on a work cloth, a cutter driving mechanism that drives the cutter, a supporting plate that supports the work cloth thereon, and a guide that guides the cutter, the guide being disposed on the supporting plate and defining a hole formed therethrough into which an edge of the cutter is inserted, at least a part of the guide being made of an elastic member. The elastic member is disposed around the hole on the supporting plate that supports the work cloth thereon. The elastic member allows the hole to gradually enlarge as the edge of the cutter goes into the hole. Therefore, the width of the hole can be originally set as small as possible so as not to clog a work cloth in the hole. When a buttonhole slit is made in the work cloth, the cutter goes into the hole and the hole is gradually enlarged. Therefore, the work cloth is not retained in the hole. Buttonhole slits can be made on a thick and heavy cloth correctly without any interruption from the work cloth being retained in the hole. In addition, the load placed on the cutter driving mechanism can be reduced, therefore, a solenoid can be used in the cutter driving mechanism. As a result, the invention provides appropriate buttonholes on a thick and heavy cloth, and realizes the cycle time reduction fully.

In a preferred aspect of the invention, a hard material is used for a peripheral edge portion around the hole of the guide. The hard material that defines the hole is movably disposed in a direction of the cutter width. The elastic member moves the hard material outward in the width direction as the edge of the cutter is inserted into the hole. In other words, when the edge of the cutter or a part of the work cloth, which is to be cut, makes contact with the elastic member, the elastic member is deformed, causing the hard material to move outward and the width of the hole to be enlarged. Because of this, the hole can be enlarged with stability even if the cutter becomes dull. Furthermore, the hole is hardly deformed due to abrasion even if it is repeatedly used. Therefore, the stable cutting performance and prevention of the work cloth from clogging in the hole can be obtained for a long time.

In another preferred aspect of the invention, the elastic member of the buttonhole forming apparatus is made of rubber. Because the rubber serves as a tight seal, dust of thread scraps, which is generated normally after the cutter cuts a buttonhole slit on the work cloth, is little clogged in the hole. Therefore, the function of the elastic member that enlarges the hole can be obtained for a long time with greater stability. This also ensures stable cutting performance and prevents the work cloth from remaining clogged in the hole for a long time. The arrangement and assembling operation for attaching the rubber around the hole, and maintenance including cleaning can be extremely simplified, comparing with the case where the other member, such as a spring, is used. As a result, the cost of manufacturing can be reduced.

In a further preferred aspect of the invention, the rubber defines a hollow at a bottom surface thereof. The rubber as the elastic member has a plurality of hollows that improve its flexibility. This can ensure the stable cutting performance and prevention of the work cloth from remaining clogged in the hole for a long time. Therefore, the load placed on the cutter driving mechanism can be reduced, bringing a further cycle time reduction. Because the hollows are not open through the top of the supporting plate, dust of thread scraps will not fall from the supporting plate to the hollows.

In another preferred aspect of the invention, the cutter driving mechanism includes a solenoid that drives the cutter. Therefore, the operational speed of the cutter can be speeded up. As a result, the cycle time reduction can be fully realized.

In a further preferred aspect of the invention, the buttonhole forming apparatus further comprises a fixing member that maintains the guide in fixed position with respect to the supporting plate. This prevents the elastic member and hard material from rising from the supporting plate after the cutter makes a buttonhole slit on a cloth. Therefore, dust of threads can be kept from going under the elastic member or hard material, and maintenance, including cleaning, can be further simplified.

In another preferred aspect of the invention, at least a part of an inner wall of the hole is tapered to expand in a working direction of the cutter. Because the edge of the cutter is guided along the tapered inner wall, the cutter can be smoothly inserted into the hole.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A preferred embodiment of the invention will be described in detail with reference to the accompanying drawings.

Figure 1:
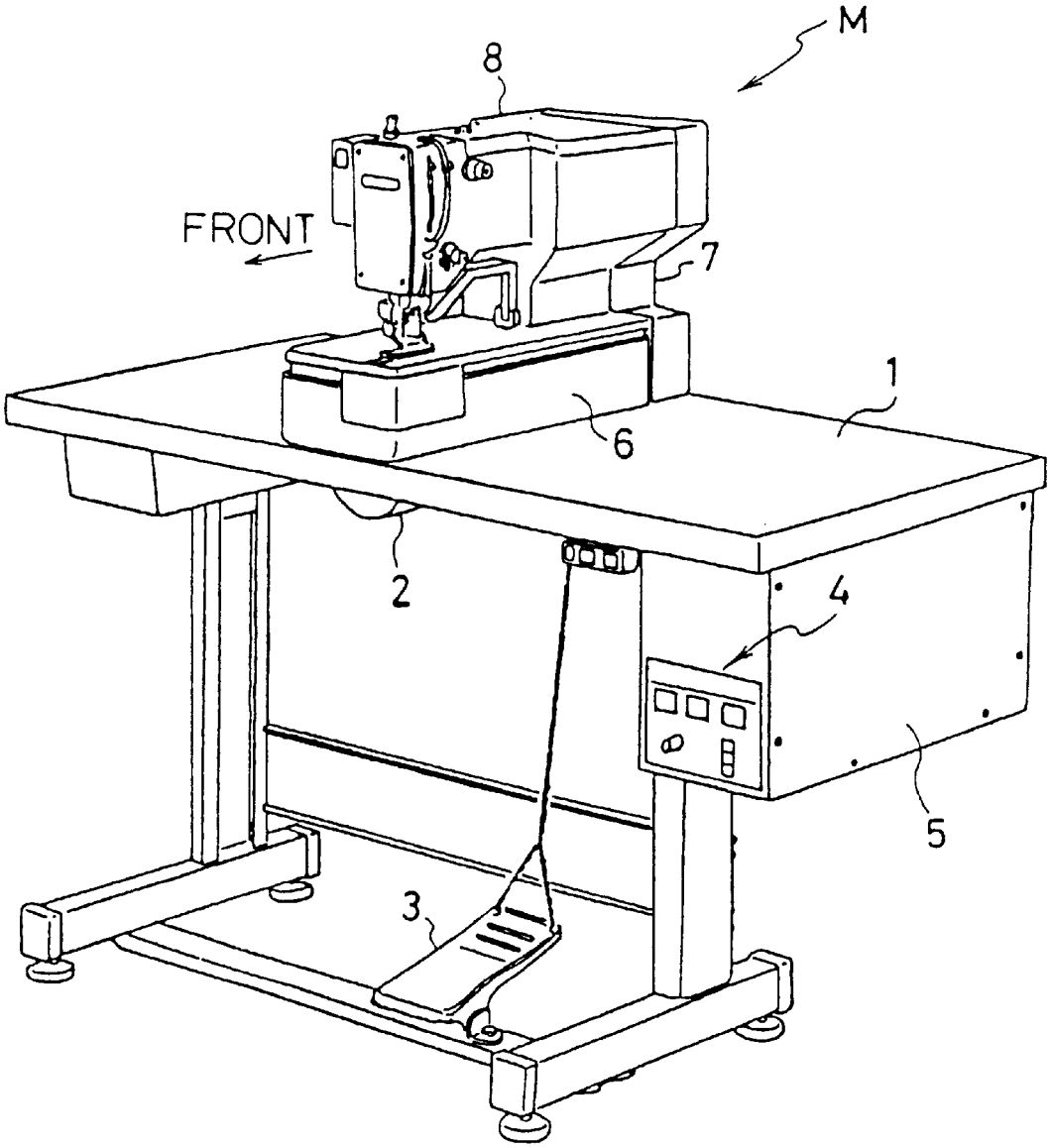
FIG. 1 is a perspective view of a buttonhole sewing machine to which the invention is applied.
Figure 6:
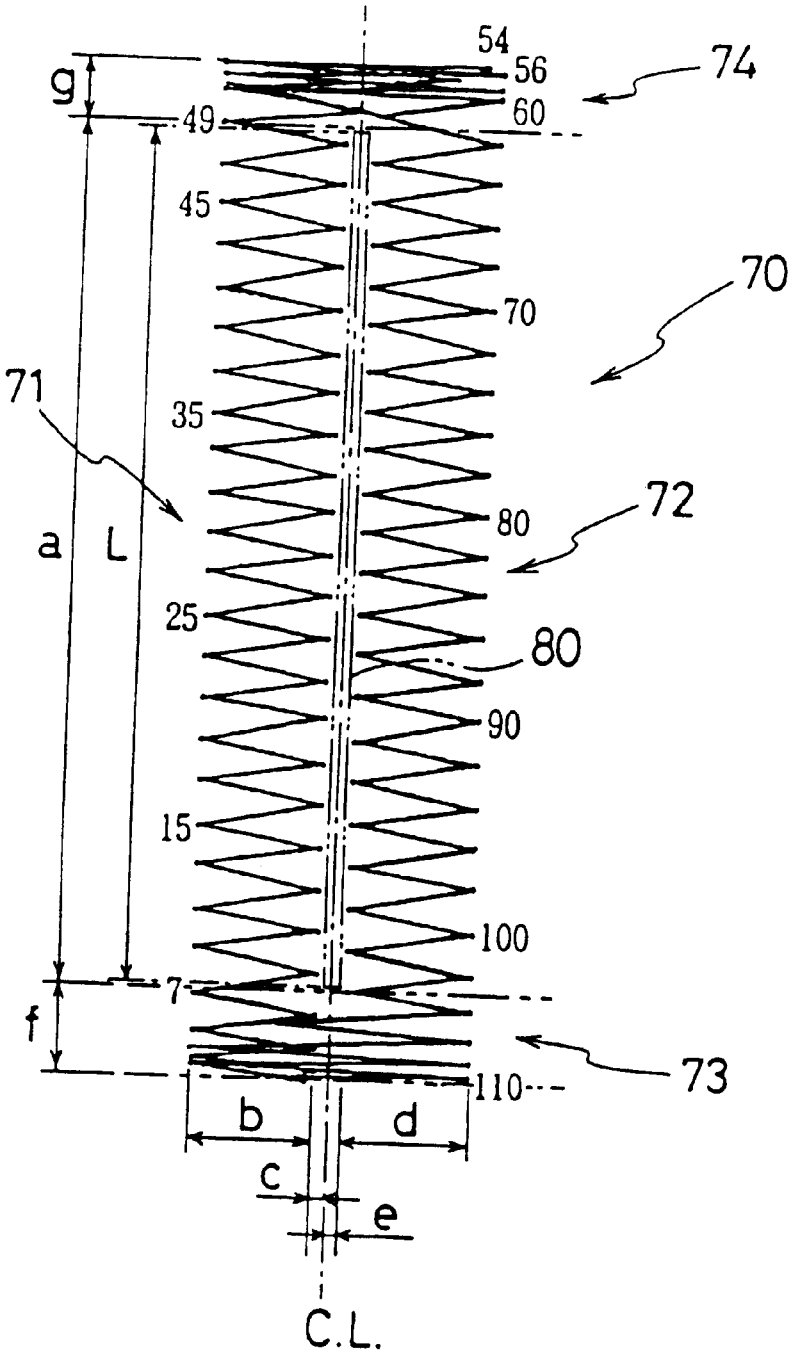
FIG. 6 shows a stitch formation for a buttonhole formed on the sewing machine.

FIG. 1 illustrates a buttonhole sewing machine M to which the invention is applied, viewed in perspective. The sewing machine M sews buttonhole stitch 70 (FIG. 6) on a work cloth W (FIG. 10), and cuts a slit between left and right zigzag stitches 71 and 72 of the buttonhole stitch 70, to form a buttonhole 80 (FIG. 6).

As shown in FIG. 1, the sewing machine M includes a machine table 1, a machine motor 2, a pedal 3 for starting and stopping the motor 2, an operation panel 4 on which various data is inputted to form buttonhole stitch 70 and a buttonhole 80, a controller 5 to control each mechanism, which will be described later, a bed 6, a standard portion 7, and an arm 8.

Figure 2:
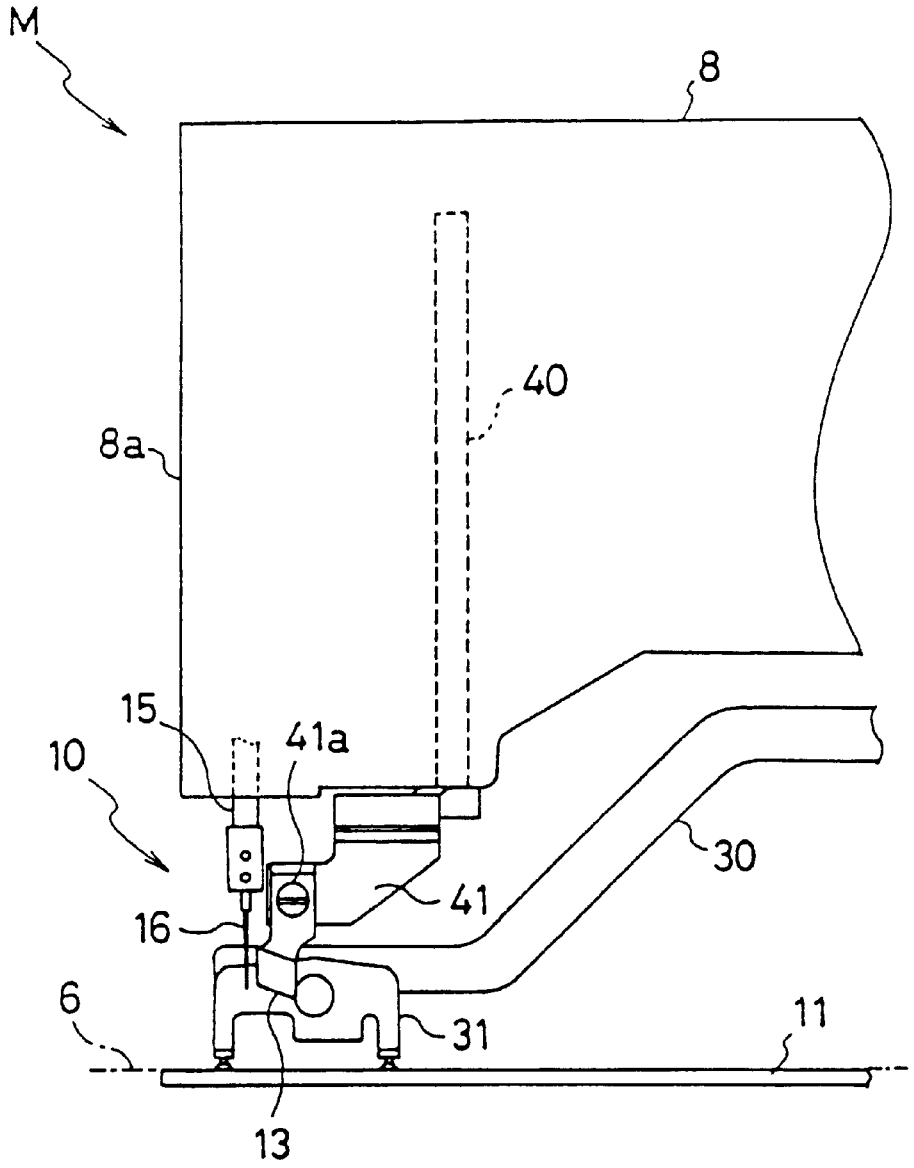
FIG. 2 is a side elevation of substantial parts of the sewing mechanism viewed from the right.

FIG. 2 shows substantial parts of a sewing mechanism 10 where the buttonhole stitch 70 is formed. The sewing mechanism 10 is linked to a feed bracket 11 that feeds the work cloth W in accordance with the stitch formation, a feed bracket driving mechanism 12 (FIG. 3) that moves the feed bracket 11 in a feeding direction of the work cloth W, a cutter 13 that cuts the work cloth W to make the buttonhole 80 between left and right zigzag stitches 71, 72, and a cutter driving mechanism 14 (FIG. 4) that moves the cutter 13 up and down.

As shown in FIG. 2, the sewing mechanism 10 comprises a needle bar 15 that is disposed in a head 8*a* of the arm 8, a needle 16 that is detachably fixed to the bottom of the needle bar 15, a needle bar driving mechanism (not shown) that allows the needle bar to move vertically and oscillate laterally, and a rotating shuttle (not shown) that is provided in the bed 6 and cooperates with the needle 16 to create buttonhole stitches. The buttonhole stitch 70 is formed while the sewing mechanism 10 is driven and accordingly the work cloth W is fed via the feed bracket 11. As shown in FIG. 6, the buttonhole stitch 70 comprises the left zigzag stitch 71 and the right zigzag stitch 72. It further has a front bar tacking stitch 73 and a rear bar tacking stitch 74 at the front end and the back end respectively. During normal buttonhole sewing, a part of the front bar tacking stitch 73, the left zigzag stitch 71, the rear bar tacking stitch 74, the right zigzag stitch 72, and the rest of the front bar tacking stitch 73 are made in this order. Lengths indicated with a letter such as a, g, or f in FIG. 6 are data to be set on the operation panel 4.

Figure 3:
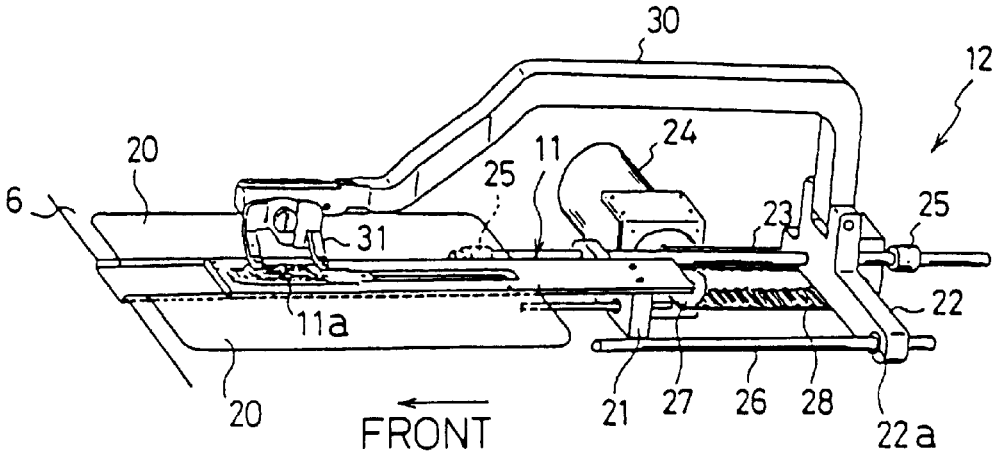
FIG. 3 is a perspective view of a feed bracket driving mechanism of the sewing machine.

Next, the feed bracket 11 and the feed bracket driving mechanism 12 will now be described. As shown in FIGS. 2 and 3, the feed bracket 11 is a long plate front to back, having a long slit 11*a* at the front end, in which the buttonhole stitch 70 and the buttonhole 80 are created. On the top of the bed 6, a pair of guide plates 20 are embedded to support the feed bracket 11 so that it can move back and forth.

The feed bracket driving mechanism 12 comprises a movable member 21 fixed to the bottom of the back end of the feed bracket 11, a movable member 22 linked to the movable member 21 with a fixed interval via a long connecting rod 23, and a stepping motor 24 that drives the movable member 22 to move back and forth.

The connecting rod 23 passes through the left holes (which are on the rear side illustrated in FIG. 3) of the movable members 21, 22. It is supported at a machine frame so as to move back and forth via a pair of bearings 25 on the outside of the movable members 21, 22. A long rod 26 is disposed on the right of the connecting rod 23. The rod 26 passes through the right hole of the movable member 22, and is supported via a bearing 22*a* so as to move back and forth.

A driving pulley 27 is fixed to an output shaft of the stepping motor 24. On the rear of the driving pulley 27, a driven pulley (not shown) is fixedly disposed in the machine frame. These pulleys are connected via a loop belt 28. The movable member 22 is fixed to a part of the belt 28. When the stepping motor 24 runs, the feed bracket 11 is moved back and forth along with the movable members 21, 22.

A cloth presser 31 is attached to a presser arm 30. The presser arm 30 is pivotally linked to the movable member 22. The cloth presser 31 is designed so that its force is applied downward by an urging member, not shown, via the presser arm 30. Thus, the cloth presser 31 fixedly presses the work cloth W down on the feed bracket 11. The cutter 13 is attached to a cutter holder 41 using a screw 41*a*. The cutter holder 41 is attached to a shaft 40 that is moved up and down by the cutter driving mechanism 14, which will be described below.

Figure 4:
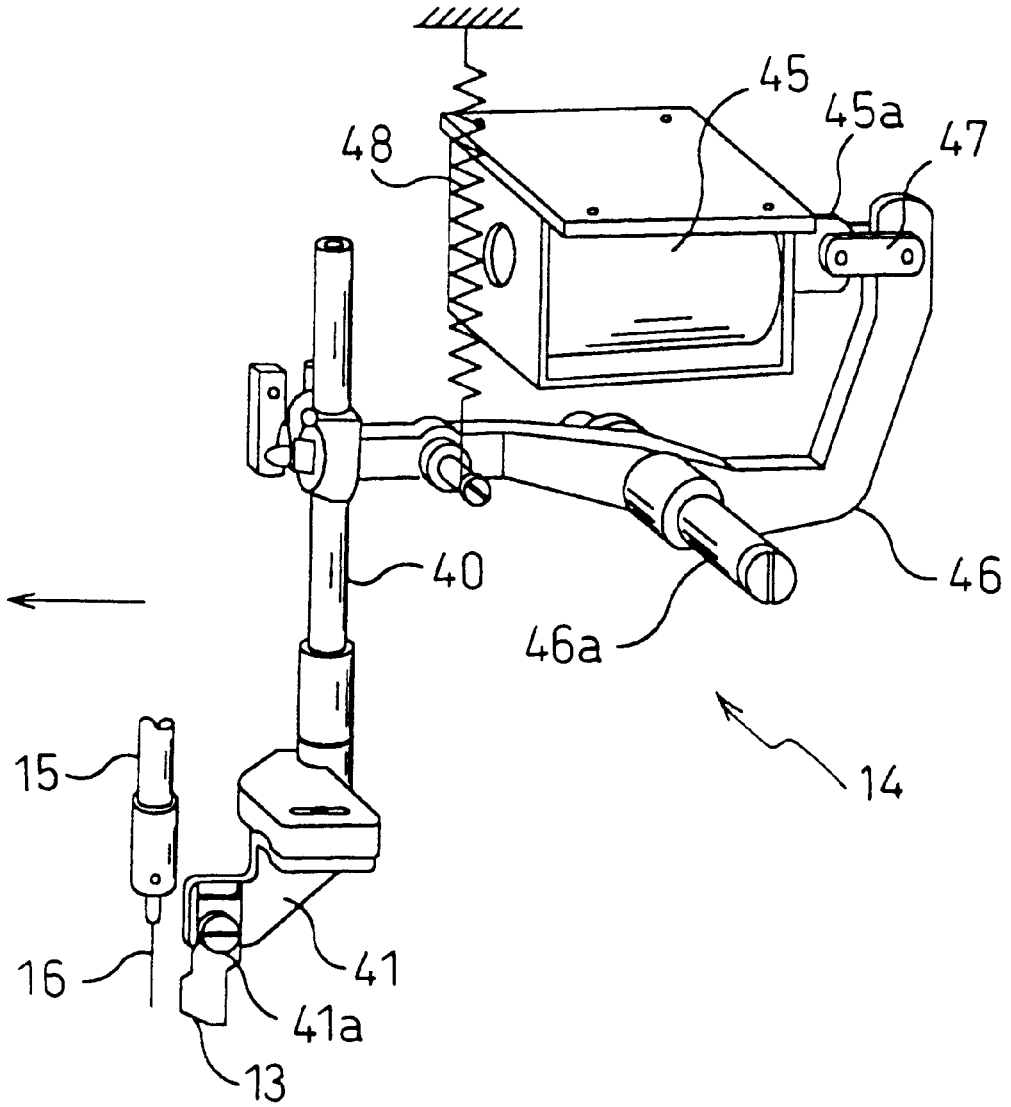
FIG. 4 is a perspective view of a cutter driving mechanism of the sewing machine.

FIG. 4 is a perspective view showing a structure of the cutter driving mechanism 14. The cutter 13 is attached to the shaft 40 slightly behind the needle 16. The shaft 40 is linked to a plunger 45*a* of a solenoid 45 for driving the cutter 13 via associated parts, such as a cutter operating arm 46. The cutter operating arm 46 is bent upward like an L shape at the rear, and oscillatably supported to the machine frame at the center via a pin 46*a*. The front end of the cutter operating arm 46 is connected to the shaft 40, and the back end of the arm 46 is linked to the plunger 45*a*, projecting backward from the solenoid 45, via a link 47. The front end of the arm 46 is pulled upward by a spring 48.

Figure 5:
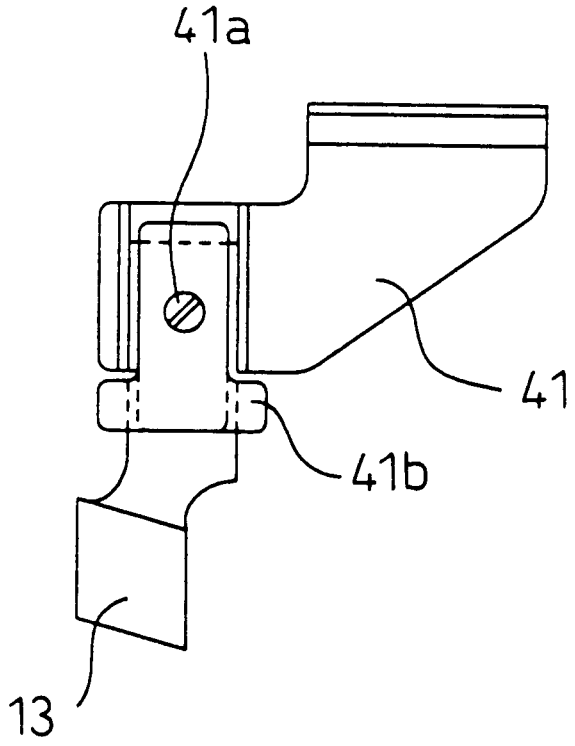
FIG. 5 is a side elevation showing the cutter and its associated parts viewed from the right.

Thus, as the plunger 45*a* of the solenoid 45 is protruded and retracted, the motion is transmitted to the shaft 40, causing the cutter 13 to move up and down. The solenoid 45 is a bidirectional solenoid that can move the plunger 45*a* toward both a protrusion direction and a retraction direction according to the status of whether the solenoid 45 is energized. Therefore, the spring 48 is good enough to have the strength that can compensate for a weight applied from the shaft 40 to the cutter 13. It is possible to omit the spring 48. The cutter 13 is fixed between the cutter holder 41 and a cutter presser 41*b* using the screw 41*a*, as shown in FIG. 5. Thus, the cutter 13 is prevented from bending toward a direction of a cloth thickness when it is moved vertically.

Figure 7:
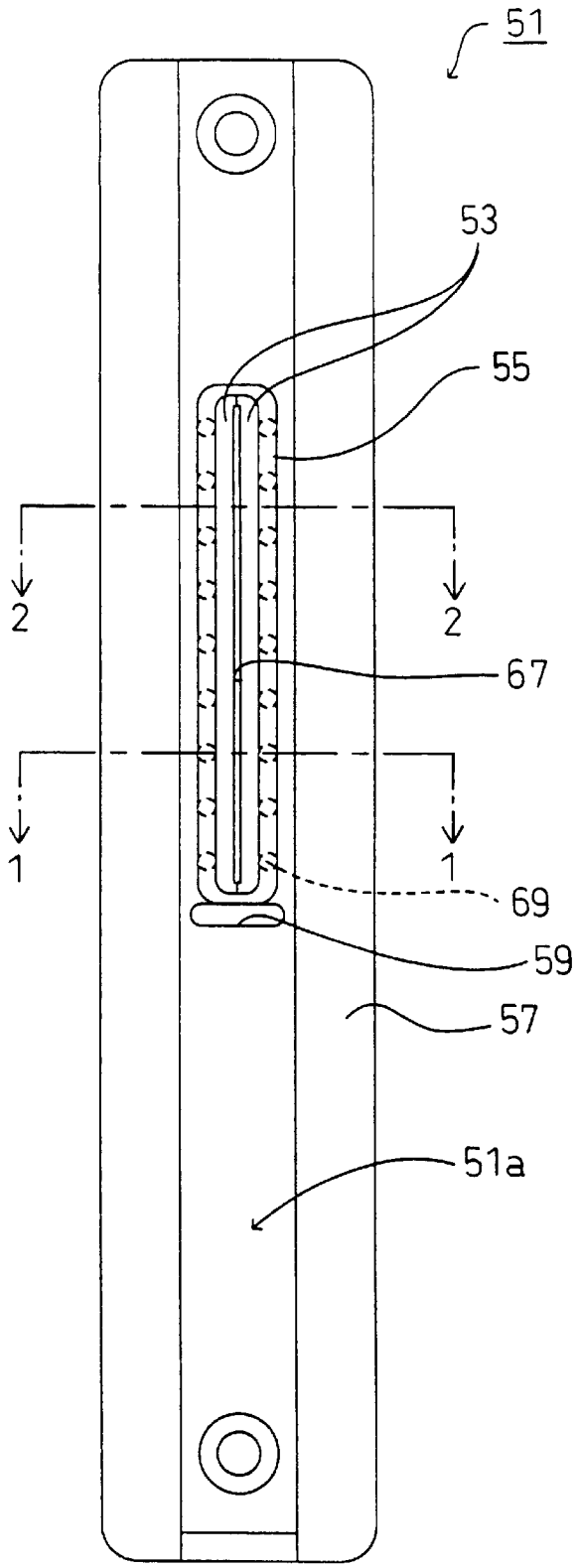
FIG. 7 is a top view showing a stricture of a needle plate and associated parts recognized as a unit.
Figure 8:
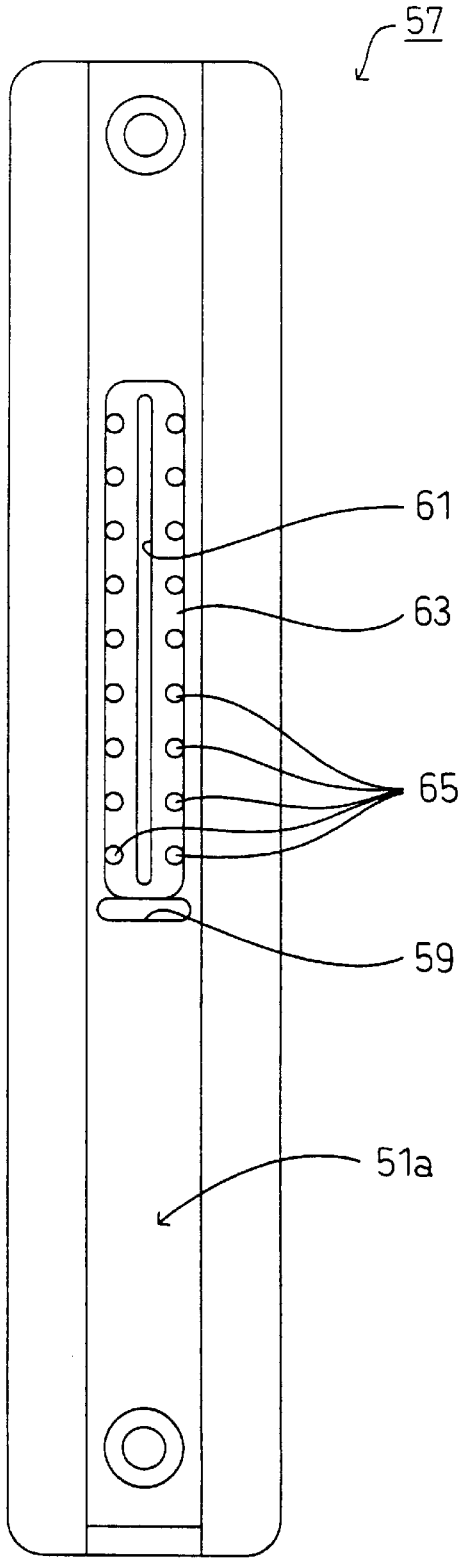
FIG. 8 is a top view of a needle plate base.
Figure 9A:
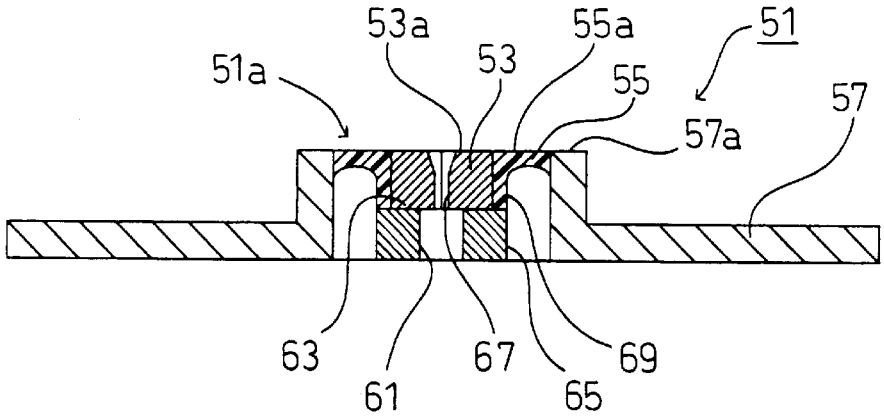
FIGS. 9A and 9B are sectional views of the needle plate base.
Figure 9B:
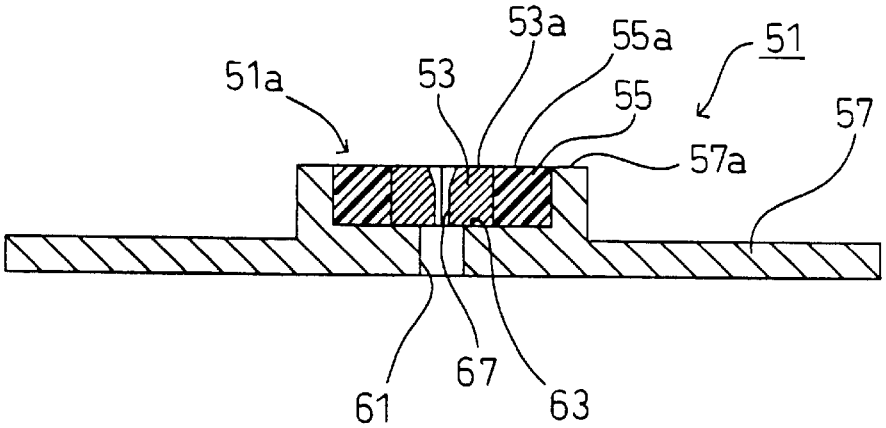
Figure 10A:
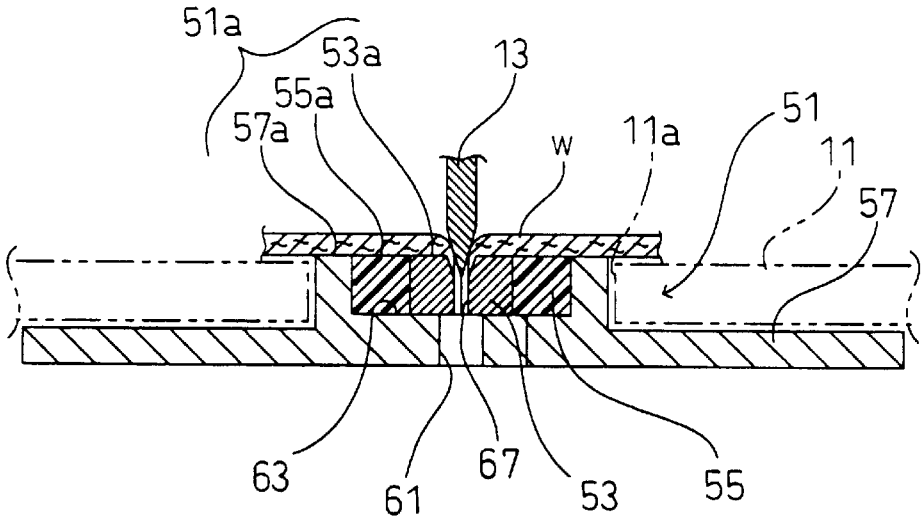
FIGS. 10A and 10B show how the buttonhole is formed on the sewing machine.
Figure 10B:
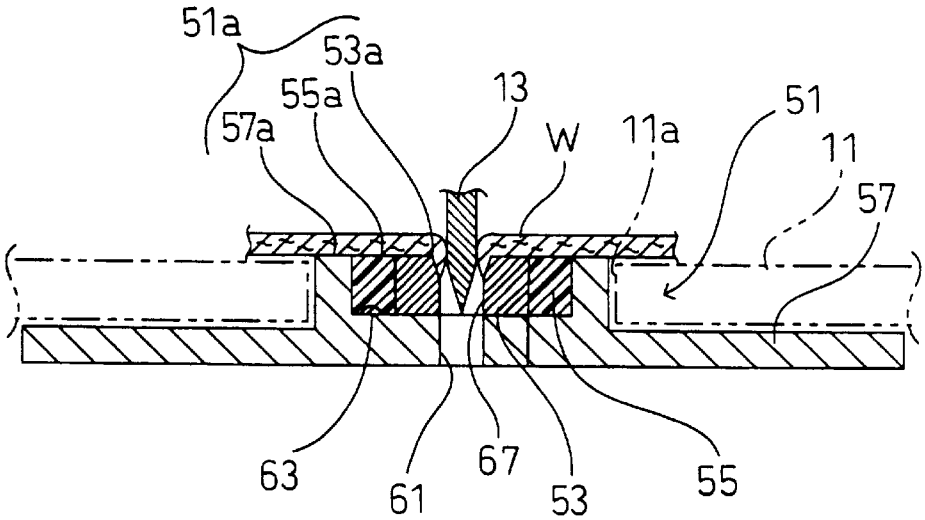
Figure 11:
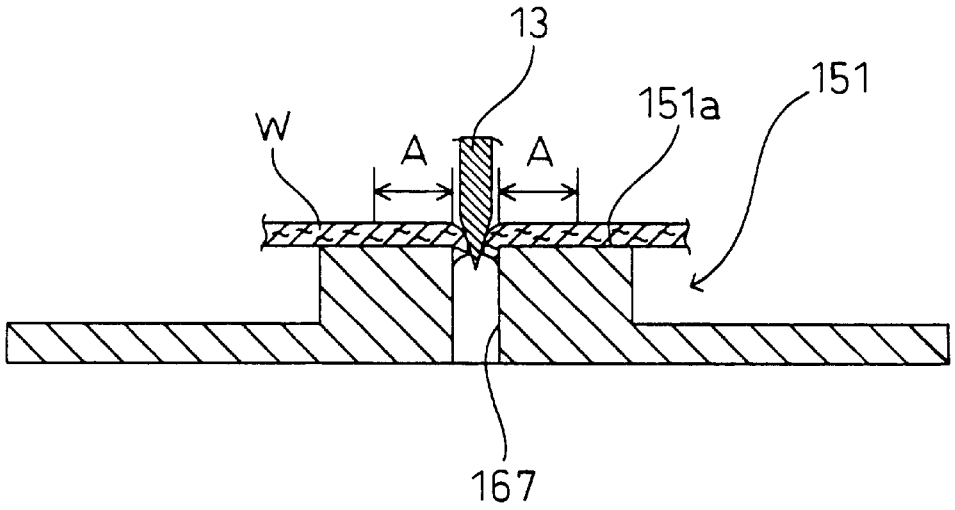
Fig.11 PRIOR ART
FIG. 11 shows how the buttonhole is formed on a conventional sewing machine.

FIG. 7 is a top view of a needle plate 51 and associated parts recognized as one part. The needle plate 51 is disposed on the underside of the feed bracket 11 by protruding a top end 51*a* of the needle plate 51 from a slit 11*a* (FIGS. 10A and 10B). FIG. 8 shows, in a top plan view, a structure of a needle plate base 57 that is when a cutter guide 53 of hard material and a rubber 55 of elastic member are removed from the needle plate 51. FIGS. 9A and 9B are sectional views at lines 1—1 and 2—2 of FIG. 7.

A buttonhole forming apparatus of the invention comprises the cutter 13, the cutter driving mechanism 14 and the needle plate 51.

As shown in FIG. 8, the needle plate base 57 has a narrow needle hole 59 and a long slit 61 provided in the back and forth direction thereon. The needle hole 59 is laterally open so that the needle 16 can be oscillated left and right therein. The slit 61 allows enough room for the edge of the cutter 13 to be inserted thereinto. As shown in FIGS. 8, 9A and 9B, a recess 63 is formed around the slit 61, and has pin holes 65 that are spaced evenly along the edge thereof On the other hand, a pair of cutter guides 53 are oppositely disposed in the recess 63 and protrude therefrom, as shown in FIG. 7. When the cutter guides 53 protrude, a cutter hole 67 is formed therebetween. The height of the cutter guides 53 is designated so that top ends 53*a* can be aligned with the top end 57*a* of the needle plate base 57 as shown in FIGS. 9A and 9B. The upper parts of the inside of the top ends 53*a*, where the cutter hole 67 is defined, are tapered. This allows the cutter 13 to enter the cutter hole smoothly.

The needle plate 51 has two main features. One is that the cutter guides 53 can be oppositely disposed at the center of the recess 63. The other is that the pin holes 65 provided in the recess 63 are not through the top end 57*a* of the needle plate base 57. To manufacture the needle plate 51 in such a structure, the pins (not shown) are inserted from the underside into the pin holes 65 of the recess 63, and a fluid rubber is poured into the recess 63 from above until it reaches the same height as the top end 57*a*. When the rubber 55 becomes solid and all pins are removed, hollows 69, which are not open to the top end 57*a*,are formed in and spaced evenly under the rubber 55. This improves the flexibility of the rubber 55.

The operation of the buttonhole forming apparatus comprising the needle plate 51, the cutter 13, and the cutter driving mechanism 14 will be now described referring to FIGS. 10A and 10B. As shown in FIG. 10A, the width of the cutter hole 67 is originally set as small as possible so that the cutter 13 does not force the work cloth W into and thereby clog, the cutter hole when it is lowered. (For example, the widest and narrowest widths of the hole are 0.5 mm and 0.4 mm respectively, as opposed to 0.8 mm of the cutter width.) As the cutter driving mechanism 14 gradually lowers the cutter 13, an edge of the cutter 13 or a part of the work cloth W, which is to be cut, makes contact with the tapered portions of the cutter guides 53, deforming the rubber 55 to enable the cutter guides 53 to move outward. Therefore, as shown in FIG. 10B, the width of the cutter hole 67 is gradually enlarged, the work cloth W is cut, and the buttonhole 80 is formed correctly without retaining the work cloth W to clog the cutter hole 67.

In the embodiment, buttonhole slits can be made on a thick and heavy cloth appropriately without the cloth remaining clogged in the cutter hole 67. The load placed on the cutter driving mechanism 14 can be also reduced. Therefore, the cutter driving mechanism 14 can be arranged using the solenoid 45 as mentioned above, allowing the cutter 13 to work very quickly. Thus, the sewing machine M can appropriately create buttonhole 80 on the thick work cloth W, and reduce the cycle time.

Because the cutter guides 53 that define the outline of the cutter hole 67 are made of hard material, they can enlarge the cutter hole 67 with stability although the sharpness of the cutter 13 may be changed. Moreover, the cutter hole 67 is hardly deformed due to abrasion even if it is repeatedly used. Therefore, the apparatus is capable of maintaining stable cutting performance and preventing the work cloth W from remaining clogged in the cutter hole 57. This also ensures that the apparatus can maintain the above mentioned [above-mentioned?] advantages, such as buttonhole forming on a thick material and a reduction of the cycle time.

In the embodiment, the cutter presser 41*b* prevents the cutter 13 from bending in the cloth thickness direction, and tapering is applied to the parts of the cutter guides 53 that define the cutter hole 67. These features ensure that the cutter guides 53 are allowed to move outward very smoothly. Therefore, it is found that the buttonhole 80 can be preferably formed in the above embodiment.

In the embodiment, the rubber 55 is provided between the cutter guides 53 and the inner wall of the recess 63. The advantage is that the rubber 55 serves as a tight seal between the top ends 53*a* of the cutter guides 53 and the top end 57*a* of the needle plate base 57. Therefore, dust from thread scraps, which is generated after the cutter 13 cuts a buttonhole slit on the work cloth W, are prevented from entering the needle base plate 32. Therefore, the apparatus can maintain the function of enlarging the cutter hole 67, as mentioned above, for a long time with great stability. The apparatus is further capable of maintaining a stable cutting performance and preventing the work cloth W from becoming clogged in the cutter hole 67. Such capabilities ensure the reduction in the cycle time and enable simple maintenance. such as cleaning.

The rubber 55 is easy to use. Its manufacture is very simple as it only requires pouring a fluid rubber into the recess 63 around the cutter guides 53. Furthermore, there is no need to prepare for an arrangement specially for attaching the rubber 55. Therefore, compared with the case wherein other member, such as a spring, is used. the arrangement and assembling operation can be extremely simplified, and the cost of manufacturing can also be reduced.

The rubber 55 has very preferable flexibility due to the hollows 69 that are provided therein. The flexibility of the rubber 55 serves to prevent the work cloth W from remaining clogged in the cutter hole 67 and further obtains the stable cutting performance of the apparatus. Thus, the load placed on the cutter driving mechanism 14 can be reduced still more, leading to a reduction in the cycle time. The hollows 69 do not pass through the top end 55*a* of the rubber 55, and the above-mentioned dust cannot gather inside. Therefore, the above-mentioned advantage can be kept for a long time, furthermore, machine maintenance, such as cleaning, can be simplified. The formation of the hollows 69 is also very simple as they are formed by pouring a liquid rubber over pins inserted into the pinholes 65 and removing the pins after the rubber is hardened. It also helps to reduce the cost of manufacturing.

That describes the invention with reference to the embodiment, but the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art. For example, the cutter guides 53 could be removed. Instead, a rubber plate can be positioned on the top of the needle plate, and a cut with the same width as the cutter hole 67 when the cutter 13 is raised can be provided thereon. Even in this case, the edge of the cutter 13 or a part of the work cloth W to be cut by the cutter 13 can press the rubber from the inside and the part of the work cloth W can be cut by gradually enlarging the cutter hole.

Instead of the rubber 55, an elastic member, such as a spring, can be provided between the cutter guides 53 and the inner wall of the recess 63.

Figure 12A:
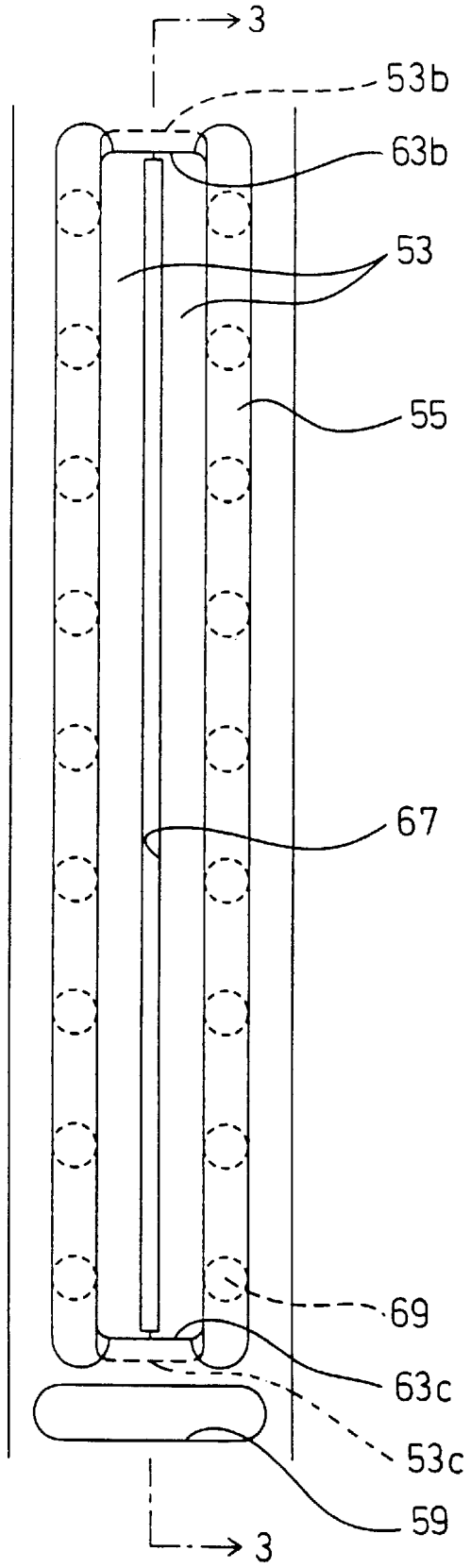
FIGS. 12A and 12B are a top view and a sectional view of a modified needle plate respectively.

The needle plate 51 may be arranged in such a manner that the rubber 55 or the cutter guides 53 can be fixed thereto without being raised. For example, as shown in FIGS. 12A top view, and 12B, sectional view along line 3—3 of FIG. 12A, the front and rear 63*b*, 63*c* of the inner wall of the recess 63 can be tapered spreading from top to bottom. The front and rear 53*b*, 53*c* of the cutter guides 53 can be tapered in accordance with the front and rear 63*b*, 63*c* of the inner wall. In this case, the cutter guides 53 can be prevented from raising from the recess 63 because of the tapered structure.

Figure 13A:
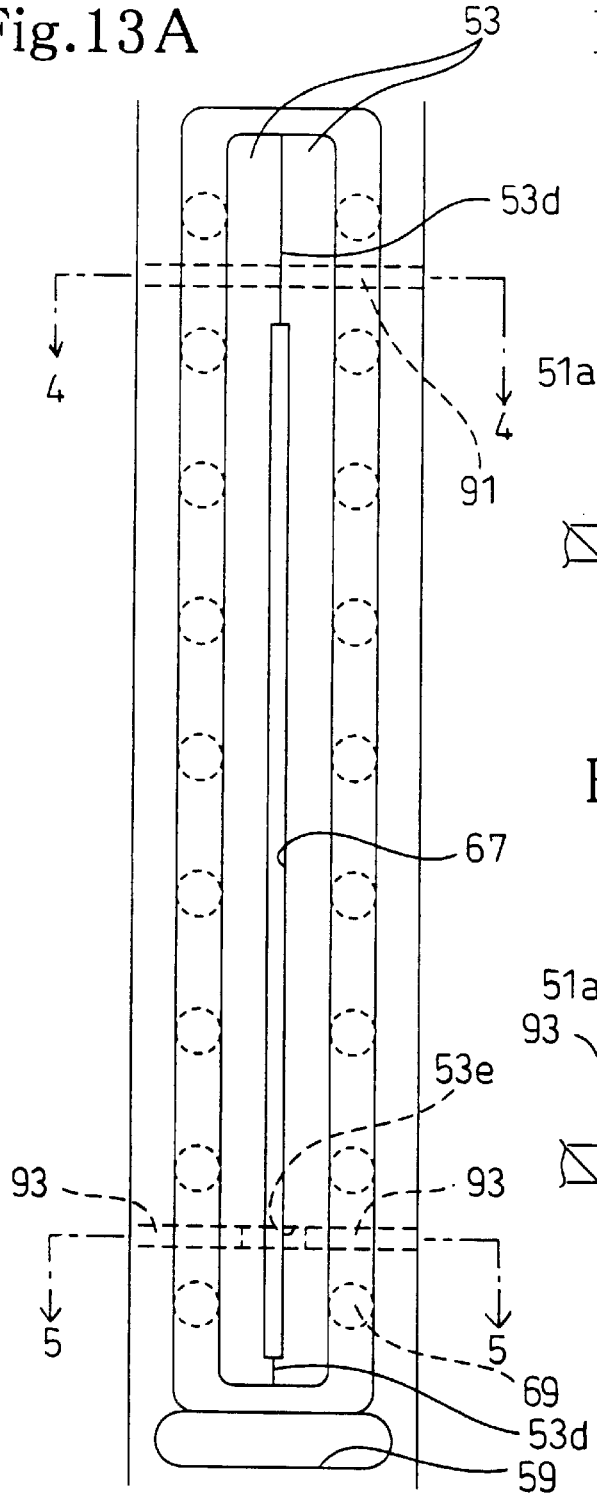
FIGS. 13A, 13B, and 13C are a top view and sectional views of another modified needle plate.
Figure 13B:
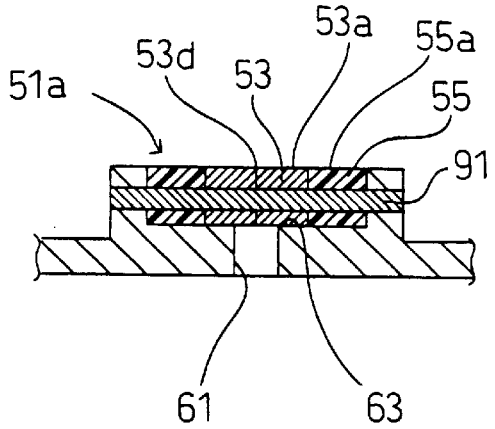
Figure 13C:
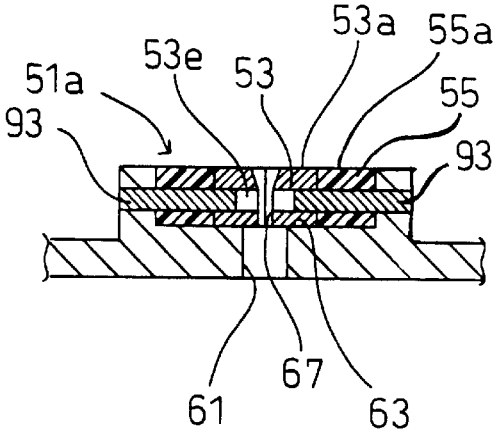

As shown in FIGS. 13A, top view; 13B, sectional view along line 4—4, and 13C, sectional view along line 5—5, pins 91, 93 can be provided so that they can horizontally pass through the cutter guides 53, the rubber 55, and the needle plate base 57. The cutter guides 53 and the rubber 55 can move along the pins 91, 93, so as not to rise from the recess 63. In FIGS. 13A–13C, the cutter guides 53 are designed so that the rear ends 53*d* are lengthened, where the pin 91 is passed through. Therefore, the pin 91 does not hinder the cutter 13 when it goes into the cutter hole 67.

On the other hand, the front ends 53*d* can not be lengthened because the cutter hole 67 should be provided as close to the needle hole 59 as possible. A pair of pins 93 is inserted halfway into each of cutter guides 53. Holes 53*e*, in which the pins 93 are inserted, arc provided through the cutter guides 53. Therefore, the pins 93 do not hinder the cutter 13 when it goes into the cutter hole 67.

Figure 12B:
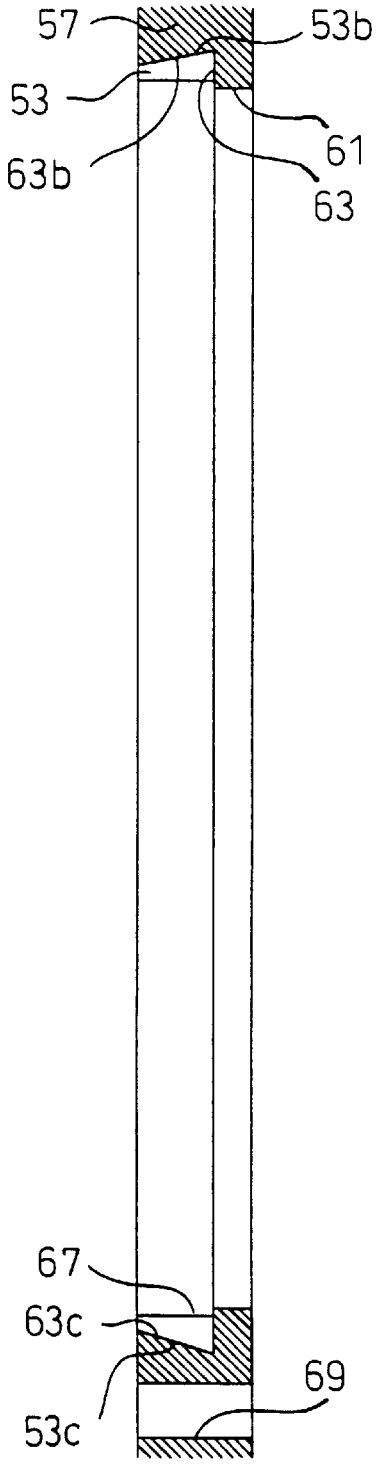

After the cutter 13 cuts the work cloth W, the rubber 55 or the cutter guides 53 rise from the recess 63, and dust could possibly gather thereunder. To prevent the cutter guides 53 and the rubber 55 from rising from the recess 63 after cutting, prevention means, such as the front and rear end 63*b*, 63*c* of the inner wall of the recess 63, or the pins 91, 93 are provided. They can prevent dust from being gathered under the rubber 55 and the cutter guides 53 (FIGS. 12 and 13). Therefore, the above-mentioned advantages, such as the reduction in the cycle time can be maintained with greater stability over the long term and machine maintenance, such as cleaning, can be further simplified.

Moreover, the needle plate 51 of the embodiment can also be applied to a buttonhole sewing machine where the cutter driving mechanism is mechanical or is run by an air cylinder. In such cases the button hole forming apparatus is capable of maintaining a stable cutting performance and preventing the work cloth W from remaining clogged in the cutter hole 57. Further, the load placed on the cutter driving mechanism can be reduced, leading to a reduction in the cycle time. However, if the cutter driving mechanism is arranged using the solenoid 45 that is a bidirectional solenoid, the vertical movement of the cutter 13 can be extremely speeded up, and the cycle time can be reduced accordingly.

Rather than a bidirectional solenoid that protrudes and retracts, a pair of unidirectional solenoids may be used. Two configurations are possible. In a first configuration, the two solenoids are on opposite sides of the cutter attaching arm 46 so that activation of one of the solenoids, the other solenoid being deactivated, causes the cutter operating arm 46 to pivot around pin 46*a* in one direction, the plunger of the second solenoid moving freely, and activation of the other solenoid causes the cutter operating arm 46 to pivot in the opposite direction, the plunger of the first solenoid moving freely. The resultant movement of driving shaft 40 and cutter holder 41 is as previously described.

The second configuration places the solenoids above one another. The cutter operating arm 46 is extended to accommodate two links 47, one above the other. One of the solenoids, upon activation, protrudes its plunger causing the cutter operating arm 46 to pivot in a first direction, the other, unactivated, solenoid plunger moves freely to a protruded position. When the other solenoid is activated, its plunger is retracted rotating the cutter operating arm 46 in the other direction, with the plunger of the first solenoid, now deactivated, moving freely. In both configurations, the solenoid having the plunger that causes the cutter operating arm 46 to rotate to the right, as shown in FIG. 4, for retracting the cutter 13 is normally activated and the other solenoid is activated, with the first solenoid deactivated, for a buttonhole cutting stroke.

EXAMPLE

A sewing machine M having the needle plate 51 as described above was produced. Tests were conducted to compare the cutting performance on the work cloth W among the sewing machine M and three different sewing machines P, Q, and R. The main difference between the sewing machines was a combination of a needle plate type and a power source for the cutting driving mechanism. The machine P has a standard needle plate, which is used conventionally, and a mechanical cutting driving mechanism that transmits the driving force of the machine motor 2 to the cutter 13 via the link. The machine Q has a standard needle plate and a cutting driving mechanism driven by an air cylinder. The machine R has a standard needle plate and a cutting driving mechanism driven by the solenoid 45, cutting driving mechanism the same as the machine M. Table 1 shows the test results for the cutting performance of each sewing machine. A test result with an asterisk mark indicates that the cutting into the work cloth W was correctly done but the cloth W was clogged between the needle plate and the edge of the cutter 13 in the cutter hole 67 and the cutter 13 did not return to its original position after cutting.

TABLE 1

Cutting Performance Comparison

| Samples | | Machine P | Machine Q | Machine R | Machine M |
|---|---|---|---|---|---|
| Material | No. of pieces | Mechanical | Air cylinder | Solenoid | Solenoid |
| | | Standard needle plate | Standard needle plate | Standard needle plate | Needle plate 51 |
| Denim 14 oz. | 2 | O | O | O* | O |
| | 4 | O | O | — | O |
| | 6 | O | x | — | O |
| | 8 | O | x | — | O |
| | 10 | O | x | — | x |
| | 12 | O | x | — | x |
| Synthetic leather A | 2 | O | O | O | O |
| Synthetic leather B | 2 | O | O | O | O |
| Synthetic leather C | 2 | O | O | O | O |
| Synthetic leather D | 2 | O | O | O* | O |

O: Passed
x: Failed
—: Not implemented

First, cutting tests were conducted using denim with a thickness of 14 ounces by varying the number of pieces of denim, as shown in Table 1. On the sewing machine R, the cutter 13 was able to cut two-ply denim, but it did not return to its original position. Therefore, further tests could not be conducted. On the other hand, on the sewing machine M1 of the embodiment, the cutter 13 was able to cut up to 8-ply work cloth W of denim smoothly, and buttonholes 80 were also created. This indicates the embodiment of the invention has a more preferable Cutting performance than the machine Q with the combination of the cutter driving mechanism driven by the air cylinder and the standard needle plate.

Next, cutting tests were performed for four different kinds of synthetic leather A, B, C, and D. On the machine R, the cutter 13 did not return to its original position after it cut synthetic leather D. On the other hand, on the sewing machine of the embodiment, the cutter 13 was able to cut all four kinds of synthetic leather smoothly. Comparing with the machine M of the embodiment, the sewing machine P had better overall cutting performance and the machine Q had cutting performance comparatively close to the embodiment. However, the speed of the machines P and Q could not be improved to have as high a speed as the machine M, and their cycle times could not be reduced to the cycle time of the machine M.

What is claimed is:

1. A buttonhole forming apparatus of a sewing, machine, comprising:

a cutter that cuts a buttonhole slit on a work cloth;

a cutter driving mechanism that drives the cutter;

a supporting plate that supports the work cloth thereon; and a guide that guides the cutter, the guide being disposed on the supporting plate and defining a hole formed therethrough into which an edge of the cutter is inserted, at least a part of the guide being made of an elastic member.

2. The buttonhole forming apparatus according to claim 1, wherein a peripheral edge portion around the hole of the guide is made of a hard material.

3. The buttonhole forming apparatus according to claim 1, wherein the elastic member is made of rubber.

4. The buttonhole forming apparatus according to claim 3, wherein the rubber defines a hollow at a bottom surface thereof.

5. The buttonhole forming apparatus according to claim 1, w herein the cutter driving mechanism includes a solenoid which drives the cutter.

6. The buttonhole forming apparatus according to claim 1, further comprising a fixing member that maintains the guide in fixed position with respect to the supporting plate.

7. The buttonhole forming apparatus according to claim 1, wherein at least a part of an inner wall of the hole is tapered to expand to have a widest dimension at an upper surface.

8. A buttonhole forming apparatus of a sewing machine, comprising:

a cutter that cuts a buttonhole slit on a work cloth;

a cutter driving means for driving the cutter;

a supporting means for supporting the work cloth thereon;

a guide means for guiding the cutter, the guide means being disposed on the supporting means and defining a hole formed therethrough into which an edge of the cutter is inserted; and an enlarging means for enlarging the hole in a direction of a blade thickness of the cutter in accordance with inserting of the cutter into the hole.

9. The buttonhole forming apparatus according to claim 8, wherein a peripheral edge portion around the cutter hole of the guide is made of a hard material.

10. The buttonhole forming apparatus according to claim 8, wherein the enlarging means is made of rubber.

11. The buttonhole forming apparatus according to claim 10. wherein the rubber defines a hollow at a bottom surface thereof.

12. The buttonhole forming apparatus according to claim 8, wherein the cutter driving means includes a solenoid which drives the cutter.

13. The buttonhole forming apparatus according to claim 8, further comprising a fixing means for maintaining the guide means in fixed position with respect to the supporting means.

14. The buttonhole forming apparatus according to claim 8, wherein at least a part of an inner wall of the hole is tapered to have a widest dimension at an upper surface.

15. A needle plate for a sewing machine having a cutter for forming a buttonhole slit on a work cloth, comprising:

a supporting plate that supports the work cloth thereon; and a guide that guides the cutter, the guide being disposed on the supporting plate and defining a hole formed therethrough into which an edge of the cutter is inserted, at least a part of the guide being made of an elastic member.

16. The needle plate according to claim 15, wherein the guide further comprises a pair of opposing cutter guides, the pair of cutter guides backed by the elastic member.

17. The needle plate according to claim 16, wherein the pair of opposing cutter guides have beveled upper, inner edges to guide the cutter by the pair of opposing cutter guides.

18. The needle plate according to claim 16, wherein the guide further comprises retention means for retaining the pair of opposing cutter guides and elastic member within the hole.

19. The needle plate according to claim 15, wherein the elastic member has a plurality of hollows formed in an underside to increase flexibility.

20. The needle plate according to claim 16, wherein the pair of opposing cutter guides arc disposed apart approximately 0.5 the width of the cutter.

21. A buttonhole forming apparatus of a sewing machine, comprising:

a cutter that cuts a buttonhole slit on a work cloth;

a cutter driving mechanism that drives the cutter;

a supporting plate that supports the work cloth thereon; and a guide that guides the cutter, the guide being disposed on the supporting plate and defining a hole formed therethrough into which an edge of the cutter is inserted, wherein the cutter driving mechanism includes one of a single solenoid which drives the cutter both in a protruding direction and a retracting direction and a pair of solenoids in which one solenoid of the pair of solenoids drives the cutter in a protruding direction when activated and the other solenoid of the pair of solenoids drives the cutter in a retracting direction when activated.

* * * * *